US007026940B2

(12) United States Patent
Cherubini

(10) Patent No.: US 7,026,940 B2
(45) Date of Patent: Apr. 11, 2006

(54) CHAIR BACK MONITORING DEVICE

(75) Inventor: Julian H. Cherubini, Boston, MA (US)

(73) Assignee: AliMed, Inc., Dedham, MA (US)

( * ) Notice: Subject to any disclaimer, the term of this patent is extended or adjusted under 35 U.S.C. 154(b) by 181 days.

(21) Appl. No.: 10/335,749

(22) Filed: Jan. 2, 2003

(65) Prior Publication Data

US 2004/0130452 A1 Jul. 8, 2004

(51) Int. Cl.
*G08B 13/26* (2006.01)
*G08B 23/00* (2006.01)

(52) U.S. Cl. ..... 340/573.1; 340/562; 340/573.4; 340/573.7; 340/686; 340/666; 128/671; 128/782

(58) Field of Classification Search ..... 340/573.1, 340/573.4, 573.7, 666, 562, 686; 128/671, 128/782

See application file for complete search history.

(56) References Cited

U.S. PATENT DOCUMENTS

| | | | | |
|---|---|---|---|---|
| 4,175,263 | A | | 11/1979 | Triplett et al. |
| 4,195,287 | A | | 3/1980 | McCoy et al. |
| 4,264,904 | A | | 4/1981 | McCoy et al. |
| 4,633,237 | A | | 12/1986 | Tucknott et al. |
| 4,858,622 | A | | 8/1989 | Osterwell |
| 4,907,845 | A | | 3/1990 | Wood |
| 5,066,943 | A | | 11/1991 | Demirel et al. |
| 5,113,176 | A | | 5/1992 | Harris |
| 5,144,284 | A | | 9/1992 | Hammett |
| 5,353,012 | A | | 10/1994 | Barham et al. |
| 5,459,452 | A | | 10/1995 | DePonte |
| 5,494,046 | A | | 2/1996 | Cross |
| 5,600,305 | A | | 2/1997 | Stafford et al. |
| 5,633,627 | A | | 5/1997 | Newham |
| 5,654,694 | A | | 8/1997 | Newham |
| 5,751,214 | A | | 5/1998 | Cowley et al. |
| 5,780,798 | A | | 7/1998 | Hall-Jackson |
| 5,796,059 | A | | 8/1998 | Boon |
| 5,808,552 | A | * | 9/1998 | Wiley et al. ..... 340/573.4 |
| 5,844,488 | A | | 12/1998 | Musick |
| 5,990,799 | A | | 11/1999 | Boon et al. |
| 6,067,019 | A | * | 5/2000 | Scott ..... 340/573.4 |
| 6,078,261 | A | | 6/2000 | Davsko |
| 6,166,644 | A | | 12/2000 | Stroda |
| 6,255,956 | B1 | | 7/2001 | Tingley et al. |
| RE37,467 | E | | 12/2001 | Brasch et al. |
| 6,544,200 | B1 | * | 4/2003 | Smith et al. ..... 600/595 |

OTHER PUBLICATIONS

AliMed, Fall Management, catalog, 2002.

* cited by examiner

*Primary Examiner*—Jeffery Hofsass
*Assistant Examiner*—Lam Pham
(74) *Attorney, Agent, or Firm*—Wolf, Greenfield & Sacks, P.C.

(57) ABSTRACT

A chair having a monitoring device disposed on the back support of the chair for detecting a change in position of a patient. The monitoring device indicates when the patient is no longer in contact with the device to provide a warning when the patient is falling forward, or is slouching in the seat. The monitoring device may be a single sensor or multiple sensors. The monitoring device may be permanently affixed to the chair, or integrated into the back of the chair. The monitoring device may be adjustable in position, or it may be moveable from the back of the chair. Multiple monitoring devices may be provided, or a single monitoring device having multiple zones may be provided or detection or more complex behavior. Typically, an output is provided to a controller which may or may not activate a warning system. The warning system may be visual, such as a light, or it may be audible, such as a siren or the like. The warning system may be either adjacent to or remote from the patient. A counter may be used to enable a time delay before a warning is sounded to avoid false alarms. A method is also provided for detecting movement of a patient in a chair utilizing a monitoring device disposed on the back support of the chair.

49 Claims, 4 Drawing Sheets

CHAIR BACK MONITORING DEVICE

FIELD OF THE INVENTION

The present invention relates generally to a chair with a monitoring device and, more particularly, to a chair with a monitoring device for detecting a change in position of a patient.

BACKGROUND

The use of mechanical restraints on nursing home residents, particularly restraints which tie a person into a chair is now severely limited by stringent government regulations. In the absence of such mechanical restraints, one problem that arises in a nursing home setting is that forgetful, demented or confused patients may seek to leave the confines of a chair without notifying a caregiver who could provide the needed assistance. Many nursing homes resort to the use of alarms to alert the caregiver that a patient is getting up from or has already left the safety of the seated position. Typically these alarms rely on a sensing device, generally a pressure sensor, that is located on the seat of a chair. An alarm sounds in response to a decrease in pressure, thus alerting the caregiver to a potentially dangerous situation. An example of such a device is found in U.S. Pat. No. 5,990,799.

Other devices use a string to tether a patient to an alarm box, which may be mounted onto a chair. When the patient attempts to leave, the patient pulls on the string thereby activating an alarm. Examples of this type of device are shown in U.S. Pat. Nos. 5,066,943 and 5,494,046.

Seat sensors have certain drawbacks. The position of the sensor pad on the seat is critical, because the sensor must be located on the spot that receives the greatest amount of sitting pressure. Also, the use of bedclothes, wheelchair cushions and other paraphernalia normally used or associated with a wheelchair can interfere with the operation of the sensor. Moreover, the use of a pressure sensor on top of a cushion (generally the preferred location) interferes with the cushioning effect, which can have deleterious effects on the health of a patient, such as the increased probability of pressure sores. Finally, the sensor pad is subject to relatively large mechanical forces, which can bend and/or flex it leading to a diminished useful lifetime because of mechanical or electrical contact failure.

Another problem arising in a nursing home setting is the tendency for a patient to slide forward in a wheelchair (sacral sitting). Sliding forward in a wheelchair places unnecessary and sometimes dangerously high forces on the sacrum. In addition, the awkwardness of the sacral sitting position can severely interfere with functioning of the patient for such things as feeding, upper arm movements and breathing.

SUMMARY OF THE INVENTION

The present invention relates generally to an apparatus and method for monitoring the movement of a patient utilizing a sensing device placed on the back support of a chair for that patient. In certain embodiments, the monitoring device comprises a single sensor disposed at a fixed location. In other embodiments, the monitoring device includes multiple zones or sensors covering a substantial portion of the back support. In certain other embodiments, the position of the sensor may be adjusted for monitoring different activities, or for patients of different sizes.

Typically, in certain embodiments, an output is provided to a controller, and the controller is coupled to a warning device. A time delay may be built into the system so that the degree of motion. The warning device may provide either a visual warning, or an auditory warning. The location of the warning device may be either local to the patient for warning the patient and nearby caregiver, or remote from the patent for warning a care giver or other interested person.

One aspect of the invention relates to a chair for a patient which has a seat, a back support and a monitoring device disposed on the back support for detecting a change in position of the patient with respect to the back support when the back of the patient is in direct contact with the back support. In one embodiment, the monitoring device comprises a contact sensor, and in another embodiment, the monitoring device comprises a pressure sensor. The monitoring device may either form a part of the back support, or be mounted thereon. In certain embodiments, the monitoring device comprises one sensor whose position is either adjustable, or whose position is fixed. The monitoring device, in one embodiment, is removably attached to the back support and its position on the back support may be adjusted by attachment at different locations. In other embodiment, the monitoring device is disposed on a sleeve covering the back support, and the position of the sleeve on the back support is adjustable. In other embodiments, the monitoring device comprises two or more sensors disposed at different locations on the back support. In one embodiment, at least one sensor is disposed adjacent a top edge of the back support for monitoring when a patient leans forward or is arising from the chair. In other embodiments, at least one sensor is disposed adjacent a lower edge of the back support to detect sacral sitting.

In another aspect of the invention, the monitoring device is coupled to a controller which in turn is coupled to a warning system. The warning system is actuable by the controller in response to signals received from the monitoring device. A counter, enabling a time delay, may be built into the system so that the degree of motion can become a determinate in the alarming signal. The warning system may either comprise a light for providing a visual signal, a read out on a computer screen, or an auditory alarm. In one embodiment, the warning system is remote from the chair and in another embodiment, the warning system provides a signal which is detectable by a patient sitting in the chair.

In another aspect of the invention, a method for monitoring a patient in a chair is disclosed. In one embodiment, the method includes locating a monitoring device on the back support of the chair to detect the presence or absence of contact between the back support of the chair and a patient sitting in the chair at that location, providing an output from the monitoring device to a controller indicative of whether the patient is in contact with the back support of the chair at that location, and providing a warning when the patient is no longer in contact with the back support of the chair at that location. In one embodiment, the locating step comprises placing the monitoring device on the back support of the chair at a location contacted by a back of a patient when sitting in a desired position in the chair, so that any movement from the desired position will be detected by lack of contact between the patient and the monitoring device. In another embodiment, the locating step comprises placing the monitoring device adjacent a lower edge of the back support to be engaged by lower back of the patient to detect slouching of the patient. In another embodiment, the locating step comprises placing the monitoring device adjacent an upper edge of the back support at a location contacted by an upper part of the back of the patient to detect leaning forward or leaving the chair.

In another embodiment, the method comprises the step of adjusting a location of the monitoring device on the back support of the chair. In other embodiments, the locating step includes locating multiple sensors on the back of the chair, or locating a single monitoring device having a plurality of independently operated sensors, or integrating the monitoring device into the back support of the chair, or placing the monitoring device on a sleeve slidable over the back support, or removably attaching the monitoring device to the back support of the chair. In other embodiments, the step of providing a warning includes providing a visual signal, an audible signal, a warning remote from the patient, a signal detectable by the patient and the like. In another embodiment, prior to the step of providing a warning, the method includes the step of processing an output from the monitoring device. In other embodiments, this processing step determines a type of movement of the patient in the chair. Other embodiments include the step of programming the controller to provide desired warnings only in response to predetermined detected movements of the patient.

The foregoing apparatus and method provides a chair which detects unwanted movements of a patient yet does not have the drawbacks of prior art chairs having sensors in the seat, including lack of comfort for the patient. This method and apparatus also provides for desired warnings to the patient and/or the care giver when unwanted movements are detected.

BRIEF DESCRIPTION OF THE DRAWINGS

Various embodiments of the invention will now be described, by way of example, with reference to the accompanying drawings, in which.

Figure 1:
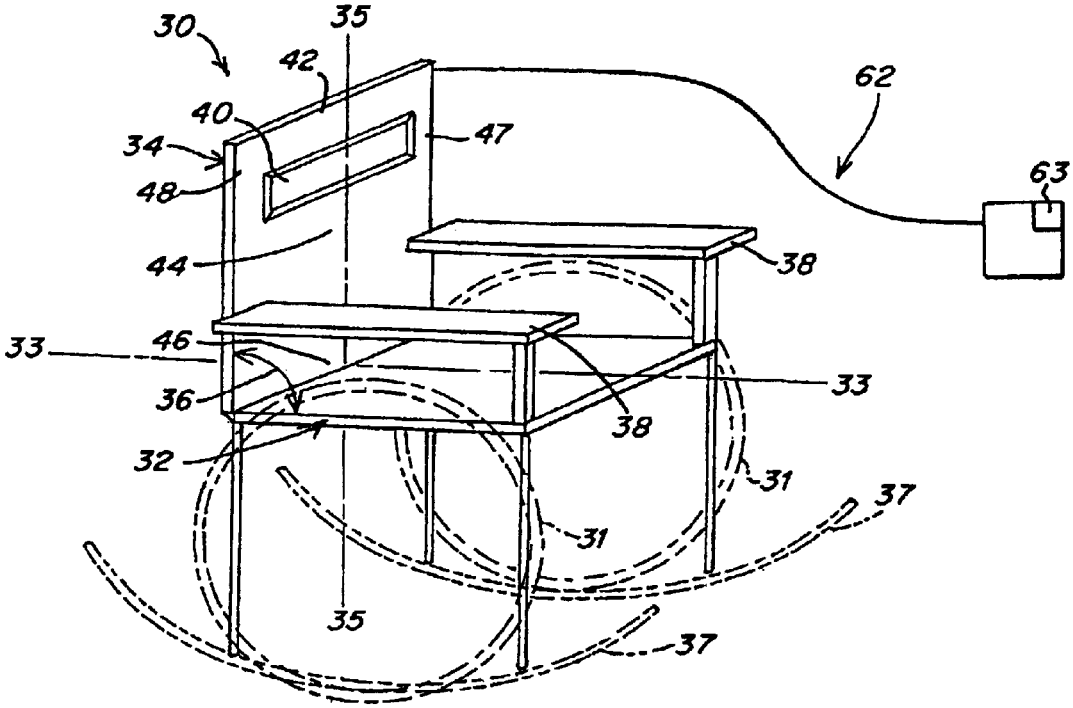
FIG. 1 is a perspective, diagrammatic representation of one embodiment of a chair back monitoring device according to the invention.

It should be appreciated that each figure may depict more than one feature of the present invention. These features may be employed singularly or in any combination, such as depicted, or as a combination of features from a variety of figures.

DETAILED DESCRIPTION

The present invention includes a chair having a monitoring device disposed on a back support of the chair. The monitoring device detects changes in position of a patient seated in the chair with respect to the back support. The monitoring device typically sends an output to a controller, which may signal a warning, thereby alerting another person or the patient him/herself to a potentially dangerous situation. The monitoring device may have a plurality of zones or be positioned in such a way that the monitoring device may recognize certain position changes as specific actions, such as sacral sitting or leaning forward, thereby, allowing for the selective monitoring of certain actions as well as for the use of the monitoring device with differently-sized patients. To achieve these and other attributes, the monitoring device may include various features, that will be described in greater detail below and that may be employed singularly or in any suitable combination.

With reference now to FIGS. 1–8, an exemplary chair 30 of the present invention will be described for use with a patient. Chair 30 includes a seat area 32 upon which a patient sits, a back support 34 for providing support to the back of the patient and a monitoring device 40 disposed on back support 34. Chair 30 may also include two or four wheels 31.

The angle between a plane 35 passing through support 34 and a plane 33 passing through seat area 32 is defined as a sitting angle 36 of the patient. Typically, sitting angle 36 ranges from about 80° to about 135°. Chair 30 typically, although not necessarily, includes two arms 38 disposed on opposite sides of the patient for providing arm support and/or for use by the patient when rising up from the chair or sitting down in the chair, and/or for providing lateral support of the patent. Chair 30 may be any type of known chair in the art, such as a wheelchair, a rocking chair having rockers 37, a chair with cushions, a chair without cushions, or a chair with three or four legs.

Monitoring device 40 is disposed on back support 34 and detects a change in position of the patient such as a change in sitting angle 36. Monitoring device 40 typically detects changes in position of the head or back of a patient. Monitoring device 40 may include any type of known position, presence or proximity sensor, such as a capacitance sensor, a sonic sensor, an ultrasound sensor, a pressure sensor, a temperature sensor, a contact sensor, a tilt sensor, an infrared sensor, or the like. Typically, device 40 provides a binary output, indicating either the presence or absence of a patient. A typical sensor for use in this invention is a pressure sensor pad, such as a pressure sensitive air bladder sensor pad made by Universal Medical Products of Trenton, N.J. It should be appreciated, however, that the present invention is not intended to be limited by the type of sensor used.

Figure 3:
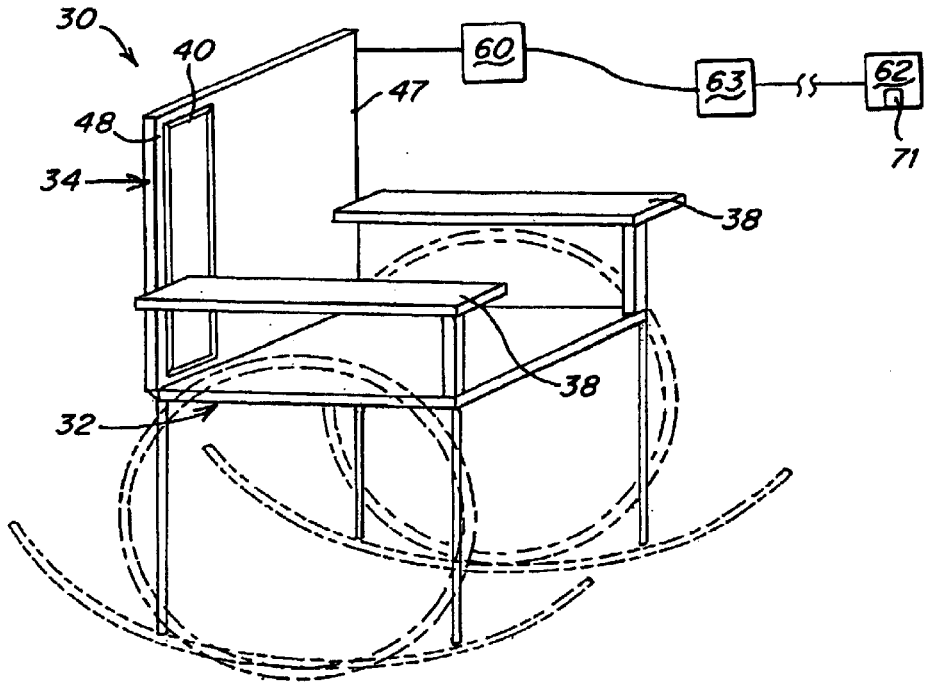
FIG. 3 is a perspective, diagrammatic representation of yet another embodiment of a chair back monitoring device according to the invention.
Figure 4:
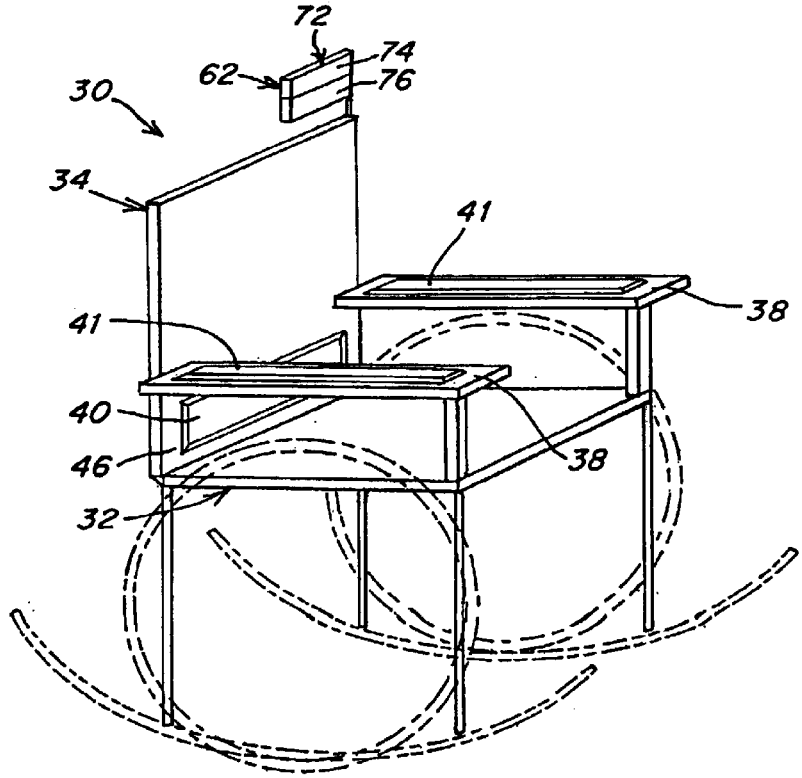
FIG. 4 is a perspective, diagrammatic representation of yet another further embodiment of a chair back monitoring device according to the invention.
Figure 5:
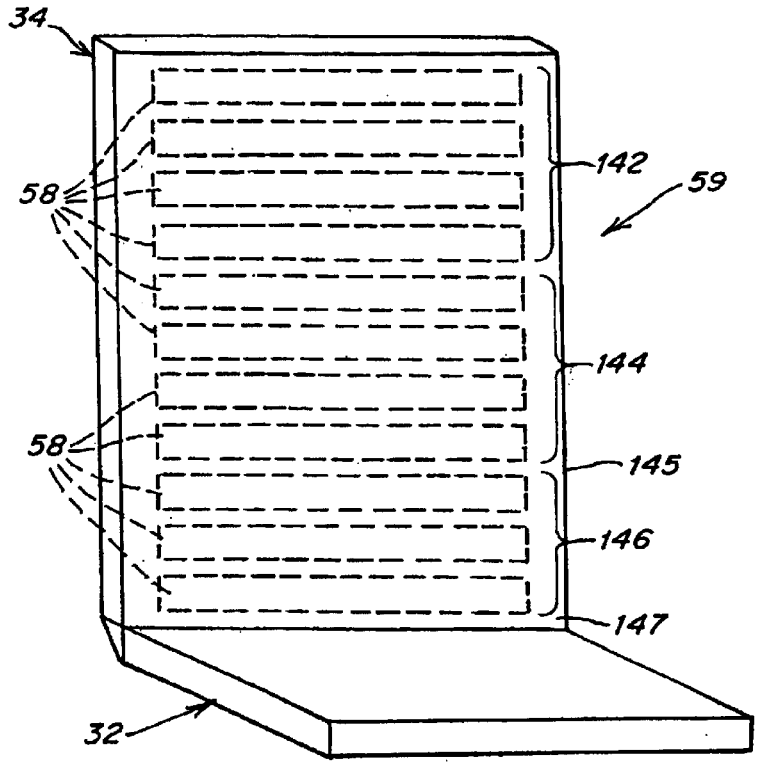
FIG. 5 is a perspective, diagrammatic representation of a multi-zoned chair back monitoring device.

Device 40 typically is retrofittedly attached to back support 34, made integrally with back support 34, or made to function as back support 34. In one embodiment such as depicted in FIG. 5, a monitoring device 59 is embedded within back support 34 such that it may not be externally visible. Typically, device 59 is embedded within a cushion 145 that forms all of or a part of back support 34 so that padding or foam 147 surrounds and covers device 59 on a side facing the back of the patient. In another embodiment, device 40 may be disposed directly on the outside surface of back support 34, facing the patient, as illustrated in FIGS. 1, 2, 3, 4 and 8.

Figure 2:
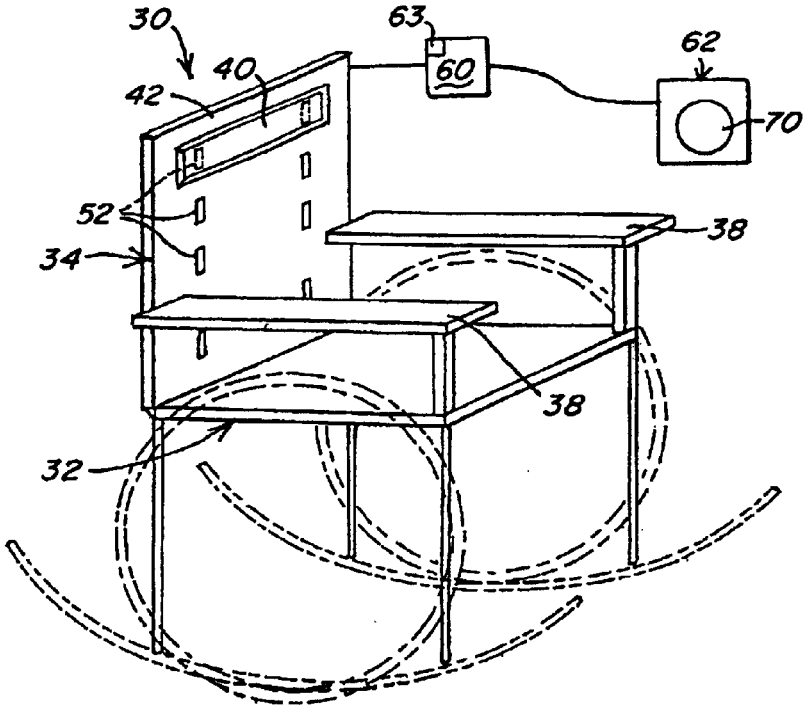
FIG. 2 is a perspective, diagrammatic representation of another embodiment of a chair back monitoring device according to the invention.
Figure 8:
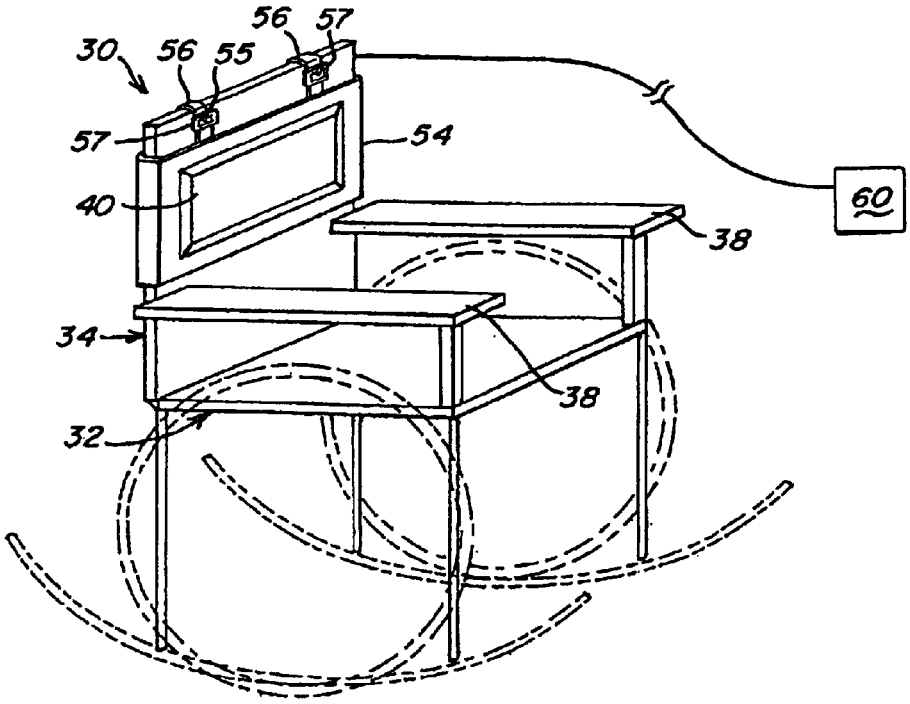
FIG. 8 is a perspective, diagrammatic representation of a removable chair back monitoring device.

In another embodiment, device 40 may be retrofittedly attached to back support 34 after support 34 has been manufactured. Examples of such devices are shown in FIGS. 2 and 8. In one example, device 40 may be removably attached to back support 34, as shown in FIG. 2. Fasteners 52 are disposed on back support 34, and on device 40 to enable device 40 to be removed and re-attached to back support 34 at any desired location. Fasteners 52 may include any conventional attachment device such as hook and loop fasteners, (i.e. Velcro®), snaps, hooks, pins, nails, magnets, rivets, adhesives, buttons, ties or a sleeve.

Another example is shown in FIG. 8 in which device 40 may be attached to back support 34 by means of a sleeve 54. Device 40 is mounted on or affixed to sleeve 54 which may be formed of any suitable material such as fabric, plastic or the like, and which is slid over the top of back support 34. Device 40 may be affixed to sleeve 54 in any known manner, such as by sewing, gluing, or by the use of fasteners such as rivets, hooks, staples, pins, snaps, buttons, Velcro® or the like.

Monitoring device 40 may be disposed at any location on or in back support 34 depending on the type of activity to be monitored. In one embodiment, as shown in FIG. 2, monitoring device 40 is placed on an upper portion of back support 34, adjacent an upper edge 42. In this location, device 40 may detect a change in sitting angle 36 such as movement of the upper back or head of the patient away from back support 34 which is indicative of a patient leaning or falling forward. In another embodiment, as shown in FIG. 4, device 40 is positioned on a lower portion of back support 34 adjacent a lower edge 46 for detecting a change in sitting angle, such as movement of the lower back of the patient away from back support 34, which may be suggestive of sacral sitting or slouching. In yet another embodiment, as shown in FIG. 5, device 40 is placed off-center on back support 34 with respect to a vertical direction or adjacent one side edge 48 of back support 34 for detecting a change in position towards or away from edge 48 of back support 34. Such movement would be indicative of leaning of the patient from side to side which could cause unnecessary strain on the spine and neck areas. It should be appreciated that a device 40 may be placed off center adjacent the other side edge 47 of back support 34 either in place of or in addition to the device 40 adjacent edge 48, enabling detection of side-to-side leaning in the opposite direction.

The exact position of device 40 on back support 34 depends on the size of the patient. For taller patients, device 40 should be closer to upper edge 42, while for shorter patients, device 40 typically is spaced below upper edge 42 at a more middle position 44, or adjacent lower edge 46.

The position of monitoring device 40 may be adjustable with respect to back support 34 and/or with respect to the patient. Adjustability permits accommodating patients with different sized torsos, and/or with different problems. For example, if the patient has a tendency to fall or lean forward in the morning and slouch in the evening, it may be advantageous to begin the morning with device 40 disposed adjacent upper edge 42 and as the day goes on, to move device 40 downwardly toward lower edge 46. The position of device 40 on back support 34 also may be adjusted for the size or shape of a patient. One example of a moveable device 40 is shown in FIG. 2 in which device 40 is held in place using fasteners 52 permitting removal and repositioning, as described. Another example is shown in FIG. 8, in which device 40 is mounted on a sleeve 54 which is suspended by straps 56 that are adjustable in length such that sleeve 54 and device 40 can be positioned at any height on back support 34. In one example, as shown in FIG. 8, straps 56 are provided with buckles 57 which allow raising and lowering of sleeve 54 on back support 34 by fixing the strap at different settings on the buckle, such as by the use of spaced holes in the strap and a pivotable pin 55 on the buckle that secures the strap by projecting through a selected one of the holes. Although sleeve 54 is shown with adjustable straps 56 it will be appreciated that any other adjustable means of attachment are within the scope of this invention. For example, snaps could be used instead of buckles 57.

In another embodiment, as illustrated in FIG. 5, instead of a monitoring device that is movable, a single monitoring device 59 may be employed that includes two or more sensors 58 disposed closely adjacent one another. FIG. 5 depicts sensors 58 in dashed lines, as sensors 58 are an internal feature of back support 34. However, it is to be understood that sensors 58 could be disposed on the exterior surface of back support 34. Device 59 also could be one sensor divided into multiple zones, closely adjacent one another. Typically, each sensor 58 provides an output separate from the outputs of other sensors 58. Multiple sensors 58 enable chair 30 to detect progressive changes in the position of the patient with respect to time. Multiple sensor 58 also allow the same device 59 to be used with different sized patients, or to allow the same device 59 to detect different movements of the same patient without having to adjust the position of the monitoring device. For example, if sensors 58 in lower portions 146 are no longer engaged over time by the lower back of the patient, but sensors 58 in upper portion 142 and middle portion 144 are engaged, it is likely that the patient has assumed a sacral sitting or slouching position. If sensors 58 in upper portion 142 are disengaged over time and sensors 58 in lower portion 146 are engaged, it is likely that the patient is slouching forward or leaving the chair.

Sensors 58 may be programmable, to provide an indication of such changes of position. The programmability of sensors 58 also may allow for differently-sized patients to use the same chair 30. For example, for a shorter patient, only sensors 58 in middle portion 144 and lower portion 146 are activated or sensed, whereas for a taller patient sensors 58 in upper portion 142, middle portion 144 and lower portion 146 all are activated or sensed. It should also be appreciated that the programmability of sensors 58 enables a caregiver to choose a specific type of movement that he or she may want to monitor, such as sacral sitting or leaning forward.

Figure 6:
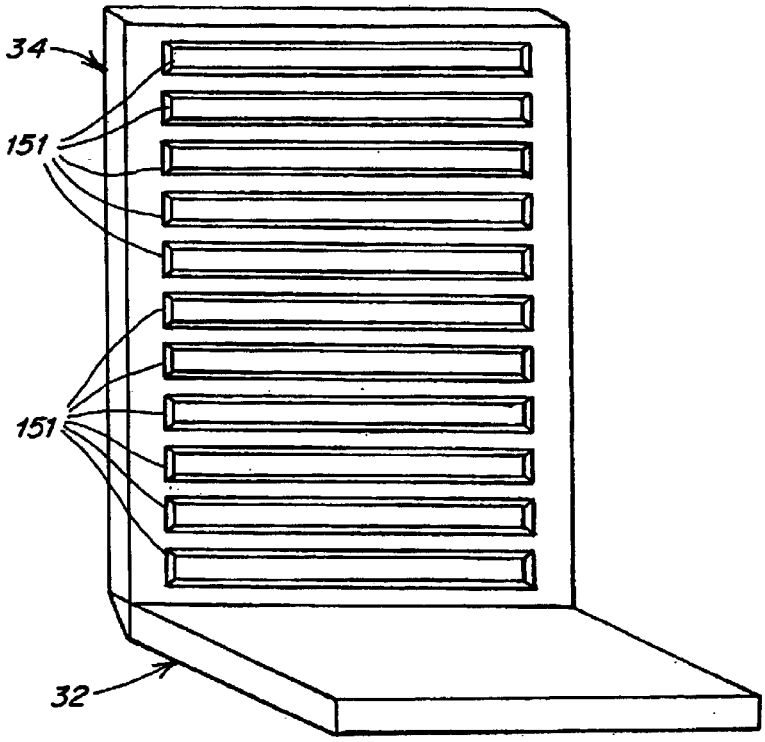
FIG. 6 is a perspective, diagrammatic representation of a chair back monitoring device divided into a plurality of zones.

In another embodiment of the invention, as shown in FIG. 6, back support 34 of chair 30 comprises multiple monitoring devices 151. Devices 151 are intended to detect a change in position of the patient, as discussed above. Each device 151 includes a sensor or multiple sensors. Typically, devices 151 function independently such that each device 151 produces its own output. Devices 151 may be disposed anywhere on back support 34. Although devices 151 are depicted as being substantially rectangular in shape and aligned in parallel horizontally, it is contemplated that devices 151 may have any geometrical shape and may be positioned at any location on back support 34 in any desired alignment. A random pattern of sizes, shapes and orientations could be used. For example, if the patient has a tendency to lean to one side 47 as well as slouch, it may be advantageous to have devices 151 along the one side 47 of back support 34 and along the lower portion of support 34 adjacent edge 46.

When a patient is preparing to voluntarily rise or change position, the patient will often use arms 38 as leverage. Therefore, a monitoring device 41 also may be positioned on arms 38 of chair 30, as shown in FIG. 4, to detect when a patient is beginning to arise from the chair or change position. It should be appreciated that a device 41 could be disposed on both arms 38 or only on one arm 38. Device 41 includes a sensor like that of device 40.

In another aspect of the invention, each device 40, 41, 59 and 151 and each sensor 58 provides an output that is sent to a controller 60. Controller 60 may be a switch, a hard wired circuit, a microcontroller, a programmable computer, or the like. Controller 60 may be programmed or hard wired to produce any desired result. If controller 60 is programmed not to trigger a warning, no action may occur. If controller 60 is programmed to issue a warning, controller 60 sends a signal to a warning system 62. The controller 60 can be implemented in numerous ways, such as with dedicated hardware (e.g., various circuitry, pre-programmed programmable logic arrays, etc.), or using one or more processors (e.g., microprocessors) that are programmed using software (e.g., microcode) to perform the various functions discussed above. It also should be appreciated that implementations of the controller 60 according to various embodiments of the invention may include both hardware and software oriented elements. Similarly, various storage devices and computer readable media discussed herein can be implemented in numerous ways, such as, but not limited to, RAM, ROM, PROM, EPROM, EEPROM, CD, DVD, optical disks, floppy disks, magnetic tape, and the like.

Warning system 62 may alert the patient, a caregiver, and/or another person or system, that the patient has changed position. Warning system 62 may be at any location depending on who is to be alerted. For example, as shown in FIGS. 2 and 4, the warning system 62 could be local to the patient to alert the patient or a nearly caregiver. Alternatively, as shown in FIGS. 3 and 8, warning system 62 could be located remote from the patient at a nurse's or caregiver's station or the like to alert a caregiver.

Warning system 62 may be either visual or auditory. In one embodiment, as depicted in FIG. 2, warning system 62, comprises a speaker 70. In another embodiment, as shown in FIG. 3, warning system 62 comprises an alarm 71. Warning system 62 may be tied into a pre-existing alarm system or it may be a self-contained or separate alarm system. Other possible embodiments of auditory alarms include sirens, bells, buzzers, chimes a recorded message, or any other acoustic alarm.

In another embodiment, as shown in FIG. 4, warning system 62 comprises a light system 72, such as a red light 74 located above a yellow light 76. Yellow light 76 may be a warning light to indicate a change in position, while red light 74 may be an alarm light to indicate an absence of the patient or a series of changes in position. Light system 72 need not comprise different colored lights, but could be multiple white lights, a single light, a blinking light, a strobe light or any number and combination of colored lights. In addition, although depicted as being attached to the top of back support 34, light system 72 may also be placed at a nurse's or caregiver's station. Other visual alarms may include a flasher, a display, a graph, a chart, a television or CRT display, or any other visible alarm.

Figure 7:
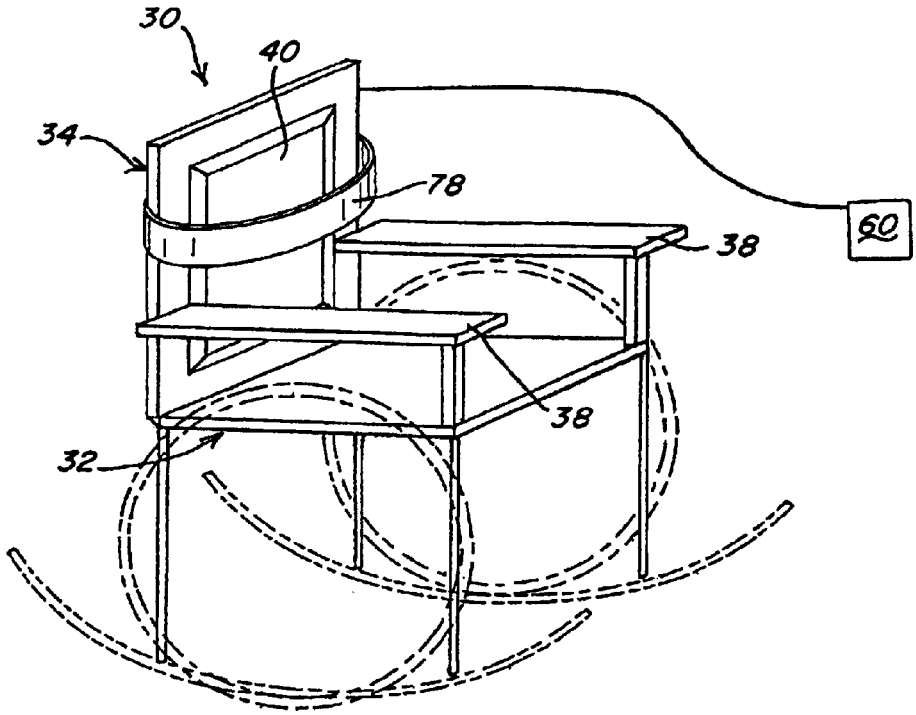
FIG. 7 is a perspective, diagrammatic representation of another embodiment of a chair back monitoring device according to the invention that comprises a restraint.

In another embodiment, as shown in FIG. 7, warning system 62 includes a seat-belt-like restraint 78 controlled by controller 60. In this embodiment, normally the patient is loosely surrounded by restraint 78 in a non-alarm situation. When activated by controller 60, restraint 78 retracts and secures the patient to chair 30.

In another embodiment of the invention, so that a momentary lack of pressure or shift in position will not prematurely or unnecessarily activate warning system 62, a counter 63 enabling a time delay may be incorporated into monitoring device 40, 41, 59 or 151, controller 60 or warning system 62, or as a separate component. For example, when a patient coughs or temporarily readjusts his/her position, the patient's back may momentarily lose contact with back support 34. Although the patient's back may return almost immediately into contact with back support 34, an alarm would otherwise be triggered, if not for counter 63, despite the fact that the patient has not exhibited any undesirable motion. Counter 63 avoids such false alarms. Preferably, counter 63 is built into either controller 60 or warning system 62 such that the alarm may only be triggered when a monitoring device 40, 41, 59 or 151 senses a lack of contact for more than a predetermined period of time.

In one embodiment, counter 63 may begin counting when the patient begins to change position or lean forward. Once the counter goes over the predetermined time delay, without renewed contact with the monitoring device, warning system 62 is triggered. Depending on the condition of the patient, different time delays may be desirable. For example, a more alert patient may be permitted to lean forward to reach for an item, or to perform another acceptable function. For such a patient a long time delay may be acceptable, such as 10 seconds. Alternatively, for a more incapacitated patient who should not be leaning forward wider any conditions, a very short delay may be required, such as one second. Counter 63 may be set to any desired time delay, such as a fraction of a second, one second, five seconds, ten seconds, thirty seconds or the like. Counter 63 may be preprogrammed by a manufacturer or programmed by the user or both, such as wherein the manufacturer allows the user to choose between certain time delay options.

The principle of a time delay may be extended to other types of thresholds. For example, in the embodiment wherein the monitoring device 40, 41, 59 and 151 is a proximity sensor, controller 60 may require that the patient be over a predetermined distance away from back support 34 to produce an alarm. In the embodiment wherein the monitoring device 40, 41, 59 and 151 is a temperature sensor, controller 60 may require a predetermined temperature change before producing an alarm. Depending on the type of monitoring device 40, 41, 59 and 151 used, any threshold or combination thereof may be employed, as the present invention is not intended to be limited in this respect.

It is also contemplated that any of the embodiments described above may be used in combination with prior art devices, such as a seat sensor, a tethering string, or another monitoring device.

In another aspect of the invention, a method for monitoring a patient is disclosed. In the method of this application, at least one device 40 for detecting the presence of a patient is positioned on back support 34 of chair 30. The location and type of monitoring device 40 depends upon the particular behavior that is to be monitored. For example, if it is desired to detect if the patient is leaning forward away from back support 34, device 40 typically is disposed on an upper portion of back support 34 adjacent an upper edge 42. If it is desired to detect sacral sitting of the patient, typically device 40 is placed on a lower portion of back support 34 adjacent lower edge 46. If it is desired to detect both behaviors of leaning forward and sacral sitting, two or more devices should be used, or a single device having multiple sensors should be used. In addition, if it is desired to monitor side to side movement of the patient, a device 40 may be provided adjacent one side edge of 48 of back support 44 or both side edges 47 and 48 of back support 34. If it is desired to monitor more complex behavior, multiple devices 40 or a device having multiple sensors may be placed on back support 34. In another embodiment of the method, the position of device 40 may be adjusted on back support 34 depending upon the behavior to be monitored, or depending upon the size of the patient to be monitored.

An output from each device 40, 41, 59 and 151 or each sensor 58 is provided to a controller 60. Typically, during normal, acceptable behavior, the patient is in contact with device 40. When the patient changes position so that the patient is no longer in contact with device 40, a signal is sent to controller 60. Depending upon the behavior being monitored, and depending upon the desired result, controller 60 may perform one of many functions. If the behavior detected is the type of behavior that is unwanted, such as leaning forward or sacral sitting, warning system 62 is activated. Warning system 62 could be a warning light, or some other visual alarm, or it could be an auditory alarm. The visual or auditory alarm could be in the vicinity of the patient to alert the patient his or herself, or it could be in the vicinity of the station of a nurse or a caregiver. Warning system 62 could also be entirely remote from the patient or could be simply a message sent to a computer screen which is being monitored at some remote location. In one embodiment, warning system 62 includes a light 72 mounted on the chair itself. In another embodiment, warning system 62 is a speaker which sounds in auditory alarm. In another embodiment, warning system 62 is an auditory alarm disposed at some remote location such as a nurse or care giver station.

If it is desired to allow the patient to move or readjust position or leave the back support for a short period of time for an accepted activity, activation of the warning system 62 may be delayed until a predetermined period of time has passed or alternatively, until the patient has moved a predetermined distance from back support 34.

The method of this invention permits monitoring of movement of a patient in a chair using a monitoring device or sensor disposed on the back support of a chair to alert either the patient or a caregiver or another person as to changes in the position of the patient in the chair or of undesirable or unacceptable movements of the patient.

It should be understood that the foregoing description of the present invention is intended merely to be illustrative thereof, and that other embodiments, modifications, and equivalents of the present invention are within the scope of the present invention, as recited in the claims appended hereto. Further, the monitoring system described above includes various features that may be employed singularly or in any suitable combination.

What is claimed is:

1. A chair for a patient, the chair comprising:

a seat;

a back support directly attached to said seat, said back support being structured to provide support for a back of the patient seated on said seat, said back support including an upper portion structured to be disposed adjacent an upper part of the back of the patient and a lower portion; and a monitoring device disposed on said upper portion of said back support for detecting a change in position of the patient with respect to said back support when the back of the patient is in direct contact with said back support.

2. The chair according to claim 1, wherein the chair comprises a wheelchair.

3. The chair according to claim 1, wherein the chair comprises a four-legged chair.

4. The chair according to claim 1, wherein the monitoring device comprises a contact sensor.

5. The chair according to claim 1, wherein the monitoring device comprises a pressure sensor.

6. The chair according to claim 1, wherein the back support comprises the monitoring device.

7. The chair according to claim 1, wherein the monitoring device is formed integrally with the back support.

8. The chair according to claim 1, wherein the back support comprises a back cushion and wherein the monitoring device is a part of or embedded into the back cushion.

9. The chair according to claim 1, wherein the monitoring device is retrofittedly attached to the exterior of the back support.

10. The chair according to claim 1, wherein the monitoring device is removably attached to the back support.

11. The chair according to claim 1, wherein a location of the monitoring device with respect to the back support is adjustable.

12. The chair according to claim 1, wherein the monitoring device comprises at least two sensors.

13. The chair according to claim 1, wherein the monitoring device comprises at least two zones, wherein each zone independently detects a change in position of the patient.

14. The chair according to claim 13, wherein at least one of the at least two zones is disposed adjacent a top edge of back support.

15. The chair according to claim 1, wherein the monitoring device is disposed on a strip that is detachable from the back support at one location, and is reattachable to the back support at another location.

16. The chair according to claim 1, wherein said monitoring device comprises a plurality of sensors disposed on said back support, each of said sensors being positioned at a location on said back support to detect a position of a patient indicative of a type of movement desired to be monitored.

17. The chair according to claim 1, wherein the change in position to be detected includes at least one of the patient leaning forward or the patient leaving the chair.

18. The chair according to claim 1, wherein the monitoring device is disposed adjacent an upper edge of the back support.

19. The chair according to claim 1, wherein said monitoring device is structured and positioned on said back support at a location spaced sufficiently far from said lower portion to allow said lower portion of said back support to contact the back of the patient when the patient is seated in the chair.

20. The chair according to claim 1, wherein said monitoring device outputs a signal.

21. The chair according to claim 20, further comprising a warning system that provides a signal in response to the signal received from said monitoring device.

22. The chair according to claim 21, further comprising a controller for receiving signals from said monitoring device in response to changes in movement of a patient with respect to said back support and for activating said warning system.

23. The chair according to claim 21, further comprising a counter enabling a time delay in activation of said warning system in response to signals received from said monitoring device.

24. The chair according to claim 23, wherein said counter enables the patient to break contact with the back support for a period of time without triggering the warning system.

25. The chair according to claim 21, wherein said warning system comprises a light for providing a visual signal.

26. The chair according to claim 21, wherein said warning system comprises an auditory alarm.

27. The chair according to claim 21, wherein said warning system is remote from said chair.

28. The chair according to claim 21, wherein said warning system provides a signal which is detectable by a patient sitting in said chair.

29. A chair for a patient, the chair comprising:

a seat;

a back support disposed adjacent said seat, said back support being structured to provide support for a back of the patient seated on said seat; and a monitoring device disposed on said back support for detecting a change in position of the patient with respect to said back support when the back of the patient is in direct contact with said back support, wherein the monitoring device is disposed on a strip that is detachable from the back support at one location, and is reattachable to the back support at another location, and wherein said strip includes one component of a hook and loop fastener, and the back support includes another component of a hook and loop fastener which is at multiple locations on said back support for attachment of said strip and said monitoring device at multiple pre-selected locations on said back support.

30. A chair for a patient, the chair comprising:

a seat;

a back support disposed adjacent said seat, said back support being structured to provide support for a back of the patient seated on said seat; and a monitoring device disposed on said back support for detecting a change in position of the patient with respect to said back support when the back of the patient is in direct contact with said back support, wherein said monitoring device is mounted on a sleeve slidable over said back support.

31. The chair according to claim 30, wherein said sleeve is adjustable for adjusting the position of the monitoring device on said back support.

32. A method for detecting when a patient in a chair leaves the chair or leans forwardly, the method comprising:

locating a monitoring device on a back support of the chair at an upper location on the back support to be contacted by an upper part of a back of the patient, the back support being directly attached to a seat of the chair, the monitoring device being structured to detect presence or absence of contact between the location on the back support of the chair and the patient sitting in the chair;

providing an output from the monitoring device indicative of whether the patient is in contact with that location on the back support of the chair; and providing a warning when the patient is no longer in contact with that location on the back support of the chair.

33. The method as recited in claim 32, wherein said locating step comprises placing the monitoring device on an upper portion of the back support of the chair at the location contacted by the upper part of the back of the patient when sitting in a desired position in the chair, so that any movement of the patient from the desired position will be detected by lack of contact between the patient and the monitoring device.

34. The method as recited in claim 32, wherein said locating step comprises placing the monitoring device adjacent an upper edge of the back support of the chair at the location contacted by the upper part of the back of the patient and wherein said step of providing an output further comprises providing a signal from the monitoring device when the upper portion of the back of the patient is no longer in contact with the monitoring device to indicate that the patient leaning forward or leaving the chair.

35. The method as recited in claim 32, further comprising adjusting a location of the monitoring device on the back support of the chair.

36. The method as recited in claim 32, further comprising providing a time delay between the step of providing an output and the step of providing a warning to enable the patient to break contact with the back support for a period of time and return without triggering the warning.

37. The method as recited in claim 32, wherein said step of providing a warning comprises providing a visual signal.

38. The method as recited in claim 32, wherein said step of providing a warning comprises providing an audible signal.

39. The method as recited in claim 32, wherein said step of providing a warning comprises providing a warning remote from the patient.

40. The method as recited in claim 32, wherein said step of providing a warning comprises providing a signal detectable by the patient.

41. The method as recited in claim 32, wherein said locating step comprises locating multiple sensors on the back support of the chair.

42. The method as recited in claim 32, wherein said locating step comprises locating a single monitoring device having a plurality of independently operated sensors on the back support of the chair.

43. The method as recited in claim 32, wherein said locating step comprises integrating the monitoring device into the back support of the chair.

44. The method as recited in claim 32, wherein said locating step comprises removably attaching the monitoring device to the back support of the chair.

45. The method as recited in claim 32, further comprising, prior to said step of providing a warning, processing an output from the monitoring device.

46. The method as recited in claim 45, wherein said processing step determines a type of movement of the patient in the chair.

47. The method as recited in claim 45, further comprising programming a controller to provide desired warnings only in response to predetermined detected movements of the patient.

48. The method according to claim 32, wherein said locating step comprises structuring and positioning the monitoring device such that a lower portion of the back support spaced from the monitoring device is contacted by the back of the patient when the patient is seated in the chair.

49. A method for monitoring a patient in a chair comprising:

locating a monitoring device on a back support of the chair, the monitoring device being structured to detect presence or absence of contact between a location on the back support of the chair and a patient sitting in the chair, said locating step comprising a step of placing the monitoring device on a sleeve slidable over the back support;

providing an output from the monitoring device indicative of whether the patient is in contact with that location on the back support of the chair; and providing a warning when the patient is no longer in contact with that location on the back support of the chair.

* * * * *